US005460154A

United States Patent [19]

Mattern et al.

[11] Patent Number: 5,460,154

[45] Date of Patent: Oct. 24, 1995

[54] METHOD FOR PNEUMATICALLY PROPELLING A PROJECTILE SUBSTANCE

[75] Inventors: Charles C. Mattern, Clermonte, Fla.; Scott A. Santora, Hammontonb, N.J.

[73] Assignee: Earth Resources Corporation, Ocoee, Fla.

[21] Appl. No.: 119,717

[22] Filed: Sep. 10, 1993

[51] Int. Cl.[6] ..... F41B 11/26

[52] U.S. Cl. ..... 124/56; 124/71; 124/75; 86/50

[58] Field of Search ..... 124/56, 70–71, 124/73–77, 60, 61, 58, 63–64; 141/1, 51; 86/50

[56] References Cited

U.S. PATENT DOCUMENTS

| | | | |
|---|---|---|---|
| RE 33,799 | 1/1992 | Gold et al. . | |
| 1,806,270 | 5/1931 | Thompson | 124/56 X |
| 3,422,808 | 1/1969 | Stein et al. | 124/61 |
| 3,428,037 | 2/1969 | Capriolo et al. | 124/61 |
| 4,046,055 | 9/1977 | McDanolds et al. | 86/50 |
| 4,169,403 | 10/1979 | Hanson | 86/50 |
| 4,690,180 | 9/1987 | Gold . | |
| 4,944,333 | 7/1990 | Gold et al. . | |
| 5,134,921 | 8/1992 | Breed et al. | 86/50 |
| 5,186,219 | 2/1993 | Gold et al. . | |
| 5,210,368 | 5/1993 | Heller, Jr. et al. | 86/50 |
| 5,230,324 | 7/1993 | Van Horssen et al. | 124/71 X |
| 5,339,876 | 8/1994 | Mattern | 124/56 X |

FOREIGN PATENT DOCUMENTS

| | | | |
|---|---|---|---|
| 2120761 | 12/1983 | United Kingdom | 124/56 |

OTHER PUBLICATIONS

"Specifications for Chemical Control Site Gas Cylinder Removal, " US Army Corps of Engineers, Jun. 1987.

"Supplement C to Project Eagle–Phase II Demilitarization and Disposal of The M34 Cluster At Rocky Mountain Arsenal Final Plan (Feb. 1973) ", Jul. 1975.

"Alternative Technologies for the Destruction of Chemical Agnets and Munitions, " National Academy Press, Washington, D.C. 1993.

*Primary Examiner*—Eric K. Nicholson
*Assistant Examiner*—Harry C. Kim
*Attorney, Agent, or Firm*—Baker & Botts

[57] ABSTRACT

A projectile substance is pneumatically propelled. The projectile substance is inserted into a longitudinal bore (23) of a barrel (22) and a rupture disk (54) is attached to a first end of the barrel (22). Next, the first end of the barrel is coupled to a first end of a pneumatic reservoir (26) having a chamber (27) therein. The rupture disk (54), as attached, acts to form a seal between the longitudinal bore (23) and the chamber (27). Then, a gas is introduced into the chamber (27) until a sufficient pressure is attained within the chamber (27) to rupture the disk (54). When the disk (54) ruptures, the gas in the chamber (27) rushes into the longitudinal (23) bore with sufficient force to propel the projectile substance out of the barrel (22).

18 Claims, 1 Drawing Sheet

METHOD FOR PNEUMATICALLY PROPELLING A PROJECTILE SUBSTANCE

TECHNICAL FIELD OF THE INVENTION

This invention relates generally to methods of propelling a projectile substance and more specifically to methods of pneumatically propelling a projectile substance.

BACKGROUND OF THE INVENTION

Procedures for disarming an explosive device should minimize the potential risk of accidentally detonating the explosive material contained within the device. The explosive device often includes associated electronic circuitry for detonating the explosive. A proven disarming technique is deactivating or destroying this circuitry before it can detonate the explosive. Because such circuitry is often sensitive to tampering, the disarming procedure should deactivate the circuitry within a short time after any contact with or movement of the device has been initiated.

One procedure for disarming an electronic explosive device is to fire a projectile into the electronic circuitry of the device. The projectile should preferably pierce the device enclosure and deactivate the electronic circuitry before the circuitry can detonate the explosive material. Typically, a gun assembly is used to fire the projectile at the device enclosure. For example, a charge of smokeless gunpowder, ignited by an electric match, may impart the required momentum to the projectile.

One problem with this procedure is that the electric match can prematurely fire the gun assembly. One cause of premature firing is stray electromagnetic energy, such as radio waves, which may provide a premature ignition signal to the match. Premature firing, particularly before the gun is properly aimed or mounted, can cause damage to the gun assembly as well as to other objects in close proximity to the gun assembly.

SUMMARY OF THE INVENTION

Therefore, a need has arisen for a disarming procedure having little or no risk of premature firing of the gun assembly.

In accordance with one aspect of the present invention, a method is provided for pneumatically propelling a projectile substance. The projectile substance is inserted into a longitudinal bore of a barrel and a rupture disk is attached to a first end of the barrel. Next, the first end of the barrel is coupled to a first end of a pneumatic reservoir having a chamber therein. The rupture disk, as attached, acts to form a seal between the longitudinal bore and the chamber. Then, a gas is introduced into the chamber until a sufficient pressure is attained within the chamber to rupture the disk. When the disk ruptures, the gas in the chamber rushes into the longitudinal bore with sufficient force to propel the projectile substance out of the barrel.

A technical advantage of one aspect of the present invention is that the risk of premature firing is significantly reduced from that of known projectile substance propelling procedures.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
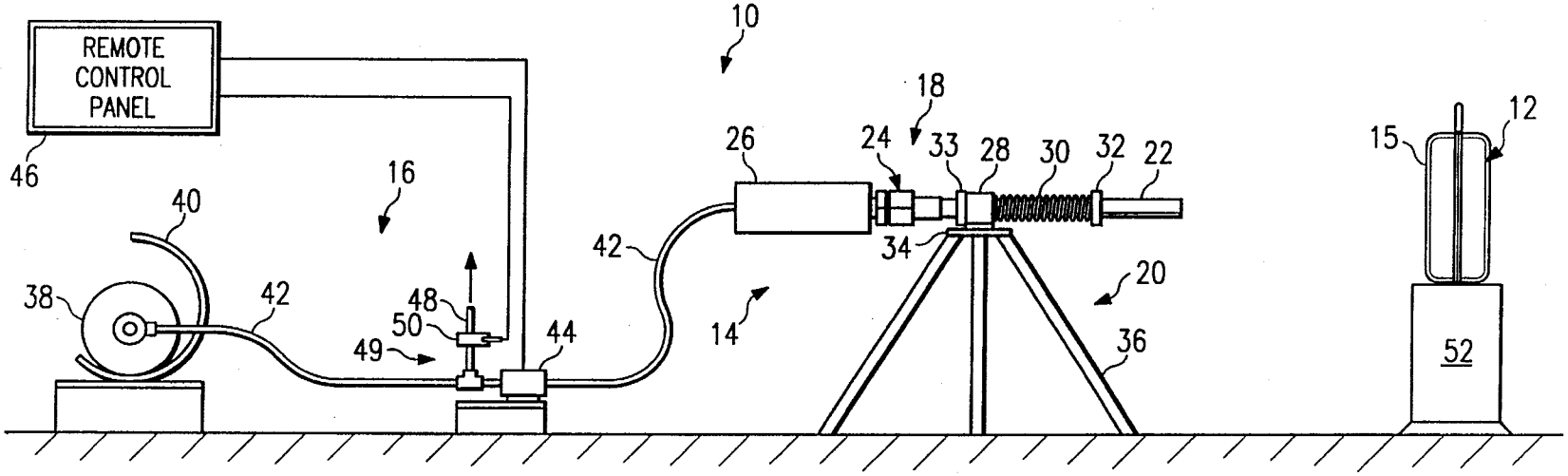
FIG. 1 is a system for disarming an explosive device incorporating the present invention.
Figure 2:
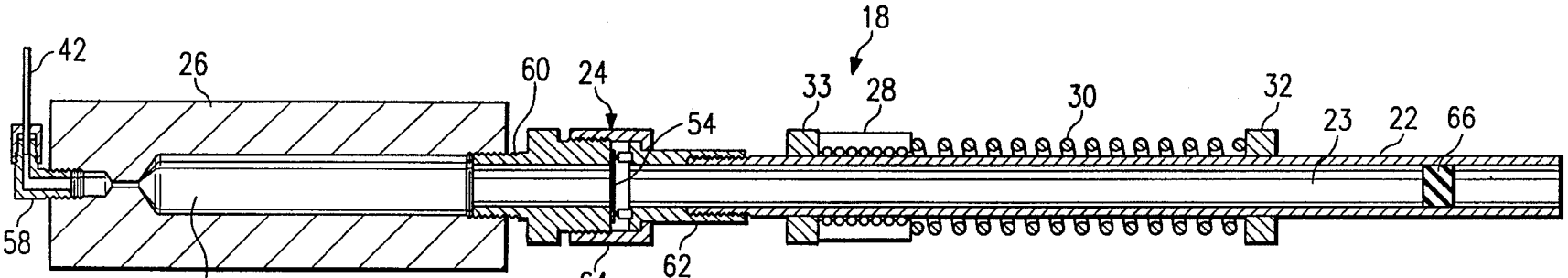
FIG. 2 is a drawing in longitudinal section with portions broken away of a pneumatic gun for use with the system of FIG. 1.

The preferred embodiment of the present invention and its advantages are best understood by referring to FIGS. 1 and 2 of the drawings, like numerals being used for like and corresponding parts of the various drawings.

FIG. 1 shows a system 10 for disarming an explosive device 12. Disarming system 10 includes a gun assembly 14 for firing at device 12 a projectile substance for piercing enclosure 15 of device 12. A pneumatic charging assembly 16 is provided to communicate pressurized gas with gun assembly 14 to fire the selected projectile substance.

Gun assembly 14 includes a pneumatic gun 18 and a mounting assembly 20. Pneumatic gun 18 includes a barrel 22 having a longitudinal bore 23 (FIG. 2) for holding and aiming the selected projectile substance prior to firing. A coupling assembly 24 attaches one end of barrel 22 to a pneumatic reservoir 26, such that a chamber 27 (FIG. 2) within pneumatic reservoir 26 communicates with longitudinal bore 23.

A portion of gun barrel 22 is preferably slidably disposed within a linear bearing 28. Collars 32 and 33 are preferably disposed on the exterior of barrel 22 spaced longitudinally from each other. Linear bearing 28 is positioned to contact collar 33. A spring 30 surrounds the exterior of barrel 22 between linear bearing 28 and collar 32. Bearing 28, spring 30 and barrel collars 32 and 33 cooperate to absorb the recoil caused by the firing of pneumatic gun 18, as discussed in conjunction with FIG. 2.

Mounting assembly 20 supports pneumatic gun 18 in the desired firing position for explosive device 12. Mounting assembly 20 includes a mounting platform 34 supported by legs 36. Legs 36, which are typically in a tripod arrangement, can rotate in an up/down direction with respect to platform 34 in order to adjust the height of gun 18.

Bearing 28 may be used to couple pneumatic gun 18 to platform 34. Bearing 28 may include a swivel joint (not shown) to allow gun 18 to swivel in an azimuth plane. Alternatively, bearing 28 may include a ball joint (not shown) to allow gun 18 to pivot in elevation as well. These optional joints provide dimensions of adjustment (in addition to the height adjustment) which facilitate the aiming of gun 18.

Charging assembly 16 includes a canister 38 for holding a gas, typically air, under pressure. Canister 38 may be a Self Contained Breathing Apparatus (SCBA) or other type of container holding a gas under pressure. A shield 40, which partially encloses canister 38, prevents any blast fragments from explosive device 12 from puncturing canister 38. Such puncturing of canister 38 may cause an additional explosion.

A high pressure gas line 42 provides communication between canister 38 and gun 18. A valve 44 regulates the gas flow between canister 38 and gun 18. A vent assembly 49, including a vent line 48 and a vent valve 50, is positioned along line 42 between canister 38 and valve 44. Vent valve 50, when open, vents gas line 42 to relieve the pressure within reservoir 26 (FIG. 2). An operator can control both valve 44 and vent valve 50 from a remote control panel 46.

Remote control panel 46 is typically located a sufficient distance from disarming system 10 to provide safety to the operator from accidental detonation of explosive device 12.

In operation, the appropriate portion of device 12 for the projectile substance to enter is determined. Typically, X-rays are taken of device 12 and analyzed to determine the appropriate portion containing the electronic triggering circuit (not shown) or component which will allow disarming of device 12. However, other non-invasive methods may be used as well. Explosive device 12 is then placed on a support 52. Alternatively, as the situation may require, explosive device 12 may be placed directly upon the ground, or left in its original position.

A projectile substance, typically comprising water, particulate material (such as sand) or a gelling agent, is loaded into barrel 22. Barrel 22 is then aimed at the appropriate portion of explosive device 12. Valve 44 is opened, and gas from canister 38 flows into chamber 27 (FIG. 2). When the pressure inside chamber 27 reaches a predetermined value, rupture disk 54 ruptures and the gas is suddenly released into bore 23. This sudden release of gas propels the projectile substance out of barrel 22 with sufficient momentum to penetrate and deactivate explosive device 12.

Once the projectile is fired, the operator remotely closes valve 44 to stop the flow of gas into reservoir 27. Alternatively, an automatic mechanism (not shown) can be installed to automatically shut valve 44 after gun 18 has been fired.

Occasionally, gun 18 malfunctions and does not fire. If such a malfunction occurs, the operator can open vent valve 50 to safely release the pressure within chamber 27 (FIG. 2) before gun 18 is serviced.

The projectile substance is typically comprised of water in whole or in part. A projectile substance comprising water provides significant advantages over other types of projectiles. Water will prevent any sparking upon penetration of enclosure 15 of device 12. Such sparking, if it were to occur, might detonate the explosive material within device 12. Additionally, the water may facilitate the destruction of any associated electronic circuitry within device 12 by causing a short circuit. Other advantages of using water as a main element of a projectile substance are it is inexpensive, easy to obtain, and safe to handle.

Although the projectile substance may comprise water alone, it is often advantageous to mix the water with either a particulate material, such as sand, or a gelling agent. Both the particulate material and the jelling agent serve to hold the projectile substance together. Without these additives, the water may tend to "spray" from barrel 22 and be less effective as a projectile.

A water base projectile substance is typically used for explosive devices having a relatively soft enclosure 15. An example of such a device is a "suitcase bomb". A water based projectile may not be as effective on a device, such as pipe bomb, having a hard enclosure 15. However, a solid projectile, such as a ball bearing, may be used in conjunction with gun assembly 14 to penetrate such a "hard-shelled" device.

FIG. 2 is a more detailed view of pneumatic gun 18. Coupling elbow 58 connects line 42 to pneumatic reservoir 26, thus establishing communication between line 42 and chamber 27. An adapter 60, having an interior bore in communication with chamber 27, is coupled to the other end of pneumatic reservoir 26. Barrel 22 is coupled to one end of a bushing 62. A coupling 64 couples the opposite end of bushing 62 to adapter 60 so that chamber 27 can communicate with longitudinal bore 23. Adapter 60, bushing 62 and coupling 64, therefore, cooperate to form coupling assembly 24.

A rupture disk 54 is disposed between adapter 60 and bushing 62 to form a fluid barrier, i.e. seal, between chamber 27 and longitudinal bore 23 until the pressure within chamber 27 becomes sufficient to burst through disk 54. Typically, disk 54 is made out of brass or bronze shim stock. ("Shim stock" is a thin piece of metal.) The thickness of the shim stock used in pneumatic gun 18 is typically between 0.0010 and 0.0020 inches. The thicker rupture disk 54 is, the higher is the pressure required to rupture it.

Brass and bronze, when used to form disk 54, provide at least two advantages over other metals. First, brass and bronze are non-sparking; neither will generate sparks upon penetration of enclosure 15 of device 12 which might ignite the explosive material therein. (Although disk 54 or any fragment thereof is not intended to become a projectile, fragments are sometimes projected from barrel 22.) Second, a brass or bronze disk 54 is soft enough to form a good seal between chamber 27 and longitudinal bore 23. That is, using a brass or bronze disk 54 eliminates the need for additional seals.

In operation, the projectile substance is loaded into bore 23 of barrel 22. In one loading procedure, coupling 64 is uncoupled from adapter 60 and slid down the outside of barrel 22 to expose the end of bushing 62. Any rupture disk 54, or part thereof, which is present from the last firing, is removed. A soft plug 66, typically made from plastic, is inserted into the opposite end of barrel 22. The projectile substance is then inserted into longitudinal bore 23 via the end of barrel 22 opposite plug 66. Plug 66 serves to prevent the projectile substance from leaking out of bore 23. A new rupture disk 54 is installed before coupling 64 is reattached to adapter 60.

In a second loading procedure, rupture disk 54 is first installed as described above. The projectile substance is loaded into bore 23 through the end of barrel 22 opposite rupture disk 54. Plug 66 is then inserted in the same opposite end of barrel 22 to prevent the projectile substance from leaking out of bore 23.

Once pneumatic gun 18 is properly loaded, it is mounted and aimed at device 12 as described above in conjunction with FIG. 1. Valve 44 (FIG. 1) is opened and pressurized gas flows into chamber 27 via line 42 and elbow 58. The pressure within chamber 27 continues to rise until it is sufficient to rupture disk 54. The force of the gas escaping from chamber 27 into barrel 22 propels the projectile substance and the plug out of bore 23. The projectile substance penetrates enclosure 15 of and disarms explosive 12.

Typically, the thickness of disk 54 is chosen so that it ruptures when the pressure within chamber 27 reaches approximately 2200 pounds per square inch (psi). However, rupture disks having rupture pressures of up to approximately 5000 psi can be used with pneumatic gun 18. The higher the pressure which builds in chamber 27 before disk 54 ruptures, the greater the momentum imparted to the projectile substance.

The explosive force of the discharging gas, in addition to propelling the projectile substance, causes gun 18 to recoil in a direction away from the discharge end of barrel 22. The recoil force causes barrel 22 to slide within linear bearing 28 in the same direction. This sliding forces collar 32 to compress spring 30 against the adjacent edge of bearing 28. Thus, spring 30 absorbs the recoil shock. Once the recoil shock is absorbed, spring 30 decompresses and forces collar 32 away from bearing 28. Barrel collar 33 limits the spring 30 decompression by abutting the other end of bearing 28. Thus, spring 30 restores pneumatic gun 18 to its prefiring position with respect to bearing 28.

Although the present invention and its advantages have been described in detail, it should be understood that various changes, substitutions and alterations can be made therein without departing from the spirit and scope of the invention as defined by the appended claims. For example, plug 66 may be formed from other materials such as cork. Also, the projectile substance may a comprise liquids other than water. Furthermore, thicker rupture disks may be used which rupture at pressures greater than 5000 psi, or less than 2200 psi.

What is claimed is:

1. A method for pneumatically propelling a projectile substance comprising the steps of:

inserting the substance into a longitudinal bore of a barrel;

attaching a rupture disk to a first end of the barrel;

coupling the first end of the barrel to a first end of a pneumatic reservoir having a chamber, wherein the rupture disk forms a seal between the longitudinal bore and the chamber;

introducing a gas into the chamber until a sufficient pressure is attained within the chamber to rupture the disk and propel the substance out of the barrel; and plugging a second end of the barrel to prevent the substance from exiting the bore until the rupture disk ruptures.

2. The method of claim 1 wherein the step of introducing comprises the steps of:

providing a pressurized canister of the gas;

coupling a first valve between the canister and a second end of the pneumatic reservoir; and opening the valve to introduce the gas into the chamber.

3. The method of claim 2 further comprising the steps of:

coupling a second valve between the first valve and the reservoir; and opening the second valve to depressurize the chamber.

4. The method of claim 1 further comprising the step of preventing the gas from flowing into the chamber after the disk has ruptured.

5. The method of claim 1 further comprising the step of mixing a liquid with a solid to form a slurry, wherein the substance is the slurry.

6. The method of claim 1 further comprising the step of forming the substance from a liquid.

7. A method of pneumatically penetrating a container comprising the steps of:

loading a projectile substance into a longitudinal bore of a barrel;

attaching a rupture disk to a first end of the barrel;

coupling the first end of the barrel to a first end of a pneumatic reservoir having a chamber so that the disk forms a seal between the longitudinal bore and the chamber;

attaining the barrel and the reservoir on a mount;

aiming the barrel at the container;

introducing a gas into the chamber;

allowing the pressure of the gas to increase until the disk ruptures, wherein the gas enters the bore, forces the projectile substance out through a second end of the barrel and the projectile substance penetrates the container; and plugging the second end of the barrel to prevent the substance from exiting the bore until the rupture disk ruptures.

8. The method of claim 7 wherein the step of introducing comprises the steps of:

providing a pressurized canister of the gas;

coupling a first valve between the canister and a second end of the reservoir; and opening the valve to introduce the gas into the chamber.

9. The method of claim 8 further comprising the steps of:

coupling a second valve between the first valve and the reservoir; and opening the second valve to depressurize the chamber.

10. The method of claim 8 further comprising the step of closing the first valve to prevent the gas from flowing into the chamber after the disk has ruptured.

11. The method of claim 7 further comprising the step of mixing a liquid with a solid to form a slurry, wherein the substance is the slurry.

12. The method of claim 7 further comprising the step of forming the substance from a liquid.

13. The method of claim 7 wherein the step of loading comprises the step of loading the substance into the first end of the barrel before the rupture disk is attached.

14. The method of claim 7 wherein the step of loading comprises the step of loading the substance into the second end of the barrel after the first end of the barrel has been coupled to the first end of the reservoir.

15. A method for pneumatically disarming an explosive device comprising the steps of:

providing a pneumatic gun assembly having a barrel defining a longitudinal bore and a pneumatic reservoir defining a chamber;

loading a projectile substance into the longitudinal bore;

attaching a rupture disk to a first end of the barrel;

coupling the first end of the barrel to a first end of the pneumatic reservoir so that the disk forms a fluid barrier between the longitudinal bore and the chamber;

mounting the gun assembly on a mount; plugging a second end of the barrel;

aiming the barrel at the explosive device;

providing a shielded canister of compressed gas;

opening a valve coupled between the canister and a second end of the reservoir to introduce the gas into the chamber;

keeping the valve open at least until the pressure of the gas within the chamber becomes sufficient to rupture the disk, wherein the gas enters the bore and propels the projectile substance out through the second end of the barrel toward the explosive device; and penetrating the explosive device with the projectile substance to disarm the explosive device.

16. The method of claim 15 wherein the step of loading comprises the step of:

loading the projectile substance into the bore through the first end of the barrel.

17. The method of claim 15 wherein the step of loading comprises the step of:

loading the projectile substance into the second end of the barrel after the first end has been coupled to the reservoir and before the step of plugging the second end of the barrel.

18. The method of claim 15 further comprising the step of mixing water with a particulate to form the projectile substance.

* * * * *